United States Patent [19]

Deutsch et al.

[11] 3,948,020

[45] Apr. 6, 1976

[54] APPARATUS FOR MANIPULATING SHEET-LIKE BLANKS IN PACKING MACHINES FOR CIGARETTES OR THE LIKE

[75] Inventors: Reinhard Deutsch; Manfred Rudolph; Karl-Heinz Pawelko, all of Hamburg; Willy Rudszinat, Dassendorf, all of Germany

[73] Assignee: Hauni-Werke Körber & Co. KG, Hamburg, Germany

[22] Filed: Apr. 7, 1975

[21] Appl. No.: 565,460

[30] Foreign Application Priority Data

Apr. 10, 1974 Germany ..... 2417515

[52] U.S. Cl. ..... 53/64; 53/389; 226/91; 226/110

[51] Int. Cl.[2] ..... B65B 57/04

[58] Field of Search ..... 53/64, 389; 226/49, 50, 226/51, 91, 110; 83/272, 650; 242/55.3, 58

[56] References Cited

UNITED STATES PATENTS

| | | | |
|---|---|---|---|
| 3,771,281 | 11/1973 | Witte | 53/389 X |
| 3,789,714 | 2/1974 | Demny | 83/272 |
| 3,821,917 | 7/1974 | Hatanaka | 83/272 |

*Primary Examiner*—Travis S. McGehee
*Assistant Examiner*—John Sipos
*Attorney, Agent, or Firm*—Kane, Dalsimer, Kane, Sullivan and Kurucz

[57] ABSTRACT

Apparatus for making and manipulating sheet-like paper, plastic or metallic blanks in a packing machine has a pivotable conveyor with a gripper which pulls the leader of a running web across the path of successive mandrels or cigarette packs on an indexible turret whereby the gripper overcomes the resistance of a mechanical or pneumatic clamping device which holds the leader of the running web in a position in which the leader can be engaged by the gripper when the conveyor completes a return stroke. The running web is severed by a pair of knives which are installed between the clamping device and the gripper and are caused to cut the web when the gripper reaches an end position in which a sufficient length of the running web is moved across the path of an oncoming mandrel or cigarette pack. A fresh web is threaded into the apparatus while the running web is being converted into a succession of blanks, and the leader of the fresh web is held at a preselected locus so that it can be moved into the range of the gripper as soon as the supply of running web is nearly exhausted. The apparatus then ceases to advance the running web and starts to advance the fresh web from the respective bobbin toward the locus where the leader of the fresh web can be engaged by the gripper. The leader of the expired web is moved out of the way not later than when the leader of the fresh web moves into the range of the gripper.

17 Claims, 3 Drawing Figures

APPARATUS FOR MANIPULATING SHEET-LIKE BLANKS IN PACKING MACHINES FOR CIGARETTES OR THE LIKE

BACKGROUND OF THE INVENTION

The present invention relates to apparatus for manipulating sheet-like blanks, particularly for making and transporting blanks in packing machines for cigarettes or the like. Still more particularly, the invention relates to improvements in apparatus for supplying a continuous succession of paper, plastic or metallic blanks to a conveyor, especially to a turret-like, chain-like or belt-like mobile carrier of entraining elements for discrete blanks.

It is known to produce a succession of blanks for conversion into components of cigarette packs or the like by drawing a web of metallic foil, paper, lightweight cardboard or synthetic plastic material from a bobbin or reel and by severing the web at regular intervals so that the web yields a succession of blanks which are thereupon converted into components of packs, either by draping the blanks directly around arrays of smokers' products or by draping the blanks around suitable mandrels. As a rule, the web is drawn from the bobbin or reel at a constant speed and without interruptions, but the conversion of its foremost portion into a succession of blanks takes place at regular or irregular intervals in synchronism with normally intermittent movements of entraining elements (packs or mandrels) on the mobile carrier. Therefore, a portion of the uncoiled web is normally caused to form an intermediate supply from which the material is being drawn prior to the making of a blank.

In order to avoid an interruption in the feed of blanks to the carrier when the supply of running web is exhausted, the just described apparatus normally comprises a splicer which attaches the leader of a fresh web to the trailing portion of the running web before the supply of running web is exhausted. This insures that the packing machine need not be arrested whenever the supply of running web is exhausted. The means for splicing may comprise a device which attaches adhesive-coated uniting bands to the trailing portions of running webs and to the leaders of fresh webs. That pack which includes a component or layer made of a blank which contains a splice (i.e., a uniting band) s segregated from the other packs before the packs are introduced into storage, into cartons or into other types of receptacles. A drawback of the just described apparatus is that the packing machine must be provided with a detector for packs which contain uniting bands and that the number of such defective packs is quite substantial, especially in a modern high-speed packing machine which can process the output of several cigarette markers each of which can turn out up to and in excess of 70 cigarettes per second.

German Offenlegungsschrift No. 2,205,366 discloses a modified apparatus wherein the fresh web is held in a position of readiness and begins to advance into the range of a severing device as soon as the supply of running web is exhausted to a predetermined extent. Each web is advanced stepwise by a separate drive, such as by discrete pairs of rollers or wheels, and the changeover from advancement of the running web to advancement of the fresh web takes place during an interval which is shorter than the interval between two successive advances of the running web. The just described apparatus need not resort to a splicer, and the entraining elements of the mobile carrier invariably receive satisfactory blanks. However, this apparatus also exhibits a number of drawbacks, particularly because the leader of the running web is pushed through the device which is actuatable to sever the running web at predetermined intervals in order to convert the front portion of the running web into a succession of discrete blanks. In other words, that portion of the running web which extends beyond the severing device is not guided and is therefore likely to curl, fold or to be otherwise deformed, especially if the web consists of extremely thin synthetic plastic material which is used for the making of transparent outer envelopes having customary tear strips. In fact, even the provision of channels, rails or analogous guide means cannot insure undue and unpredictable deformation of the foremost portion of a web which consists of cellophane or a lightweight metallic or paper sheet stock.

German Offenlegungsschrift No. 1,932,360 discloses a further apparatus wherein the two webs are attracted by two discrete suction drums and are severed while adhering to the respective drums. The thus obtained blanks are thereupon transferred onto a further conveyor which delivers them into the path of entraining elements on the aforementioned mobile carrier. One of the webs is continuously fed to the respective suction drum by a pair of driven rollers while the rollers for the other (fresh) web remain idle. The just described apparatus operates satisfactorily; however, its initial and maintenance costs are extremely high, not only because the apparatus employs two discrete suction drums but also because the apparatus must be provided with two discrete severing devices, one for the web which adheres to the other drum. Still further, the transfer of blanks from the suction drums onto the further conveyor must be effected by a complex mechanism which is prone to malfunction. Moreover, the controls of the apparatus are quite complicated, especially if the apparatus is to insure that the last blank made from an expiring web is followed, without delay, by the first blank which is obtained in response to severing of the fresh web.

SUMMARY OF THE INVENTION

An object of the invention is to provide a simple, rugged, reliable and versatile apparatus which can be used to make and transport a continuous succession of sheet-like blanks in a packing machine or the like without resorting to splicing devices and in such a way that the delivery of blanks to a mobile carrier or an analogous conveyor of the packing machine is not interrupted when the supply of a preceding web is exhausted.

Another object of the invention is to provide an apparatus which can produce blanks with a high degree of reproducibility, irrespective of whether the blanks are to be made of relatively stiff or of highly flexible or otherwise deformable sheet material.

A further object of the invention is to provide an apparatus wherein a single severing device suffices to subdivide successive webs into an uninterrupted series of blanks for the making of cigarette packs or the like.

An additional object of the invention is to provide an apparatus which insures that the last blank made from a preceding web is identical in size with the first blank which is obtained in response to severing of the next-following web.

Another object of the invention is to provide novel and improved means for advancing and gripping running webs which are to be converted into discrete blanks in a machine for the packing of cigarettes or other rod-shaped smokers' products.

An additional object of the invention is to provide novel and improved means for holding running and fresh webs in an apparatus of the above outlined character, and novel and improved means for moving such holding means in synchronism with movements of elements which receive and entrain successively formed blanks.

The apparatus of the present invention is utilized for manipulation of a succession of blanks which are obtained by severing webs of preferably flexible sheet-like material, particularly for making and transporting blanks in a packing machine for cigarettes or the like. The apparatus comprises a mobile carrier (e.g., an indexible turret) having blank entraining means (such as mandrels, pockets or partially finished cigarette packs) arranged to move along a first path (e.g., along an endless circular path), feeding means having first and second sources of discrete webs (such sources may constitute bobbins or reels each of which stores a substantial length of convoluted web stock made of paper, cellophane, metallic foil or the like) and means (e.g., driven rollers) for advancing one of the webs at a time from the respective source along second paths, means for holding the leader of the one advancing web at a first locus which is adjacent to the first path and for holding the leader of the other (fresh) web at a second locus which may be closed to or remote from the first locus, a conveyor which is movable between first and second positions and has means (e.g., a tongs) for gripping the leader of the one web at the first locus in the first position of the conveyor and for moving (preferably pulling) such leader across the first path during movement of the conveyor from its first to its second position, means for severing the web adjacent to the first locus to thereby form a blank which is moved by the entraining means along the first path, and means for transferring the leader of the one web from the first locus (e.g., when the supply of the one web is practically exhausted) and for transferring the leader of the other web from the second to the first locus in response to a changeover from advancement of the one web to advancement of the other web.

The advancing means preferably comprises a device for continuously drawing the one web from the respective source, and the apparatus preferably further comprises magazines for storage of intermediate supplies of the respective webs in predetermined portions of the second paths, preferably between the advancing means and the holding means. Still further, the apparatus preferably comprises means for intermittently moving the conveyor between its first and second positions, e.g., in synchronism with indexing of the carrier for entraining elements.

The severing means preferably comprises a stationary counterknife and a mobile knife, and the apparatus preferably further comprises means (e.g., one or more cams) for displacing the holding means during movement of the conveyor from the first to the second position so that a portion of the one web (intermediate its leader and the holding means) is closely adjacent to the stationary counterknife while the one web is being severed to yield a blank.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
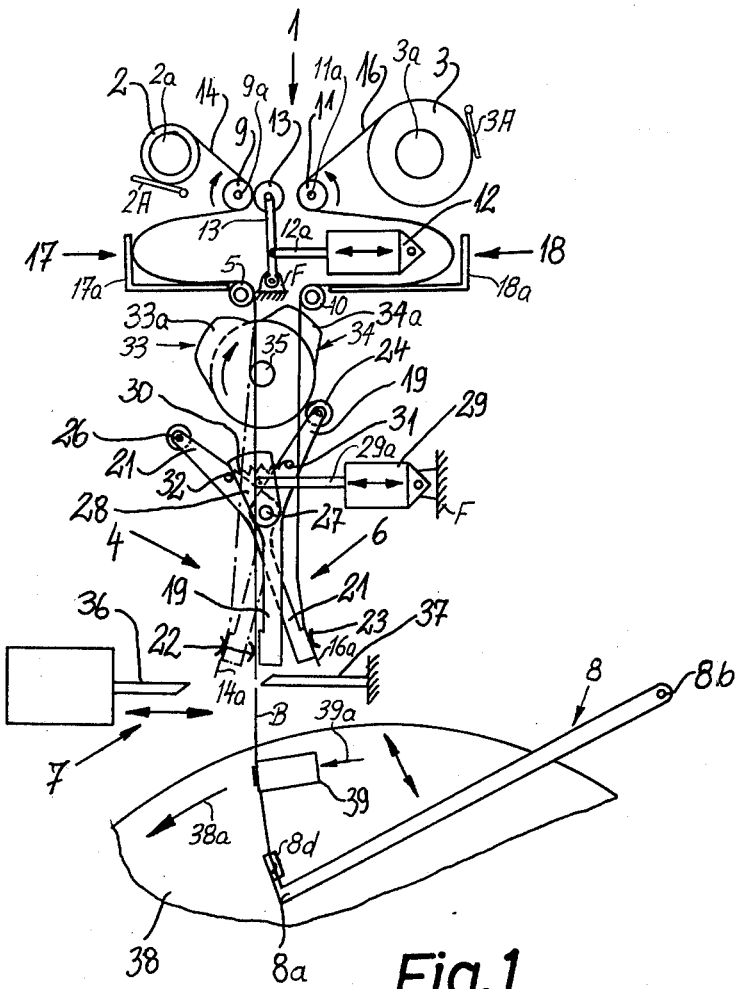
FIG. 1 is a fragmentary schematic elevational view of a first apparatus.

Referring first to FIG. 1, there is shown an apparatus for manipulating flexible sheet-like blanks B in a packing machine for cigarettes or analogous rod-shaped smokers' products. The apparatus comprises a mobile carrier 38 (e.g., an indexible turret which forms part of a packing machine and can rotate stepwise in the direction indicated by arrow 38a) for a plurality of equally spaced blank-entraining elements 39 (only one shown) which travel along an endless path. Each entraining element 39 may constitute a hollow mandrel which contains an array of cigarettes (not specifically shown) and around which a blank B is draped, folded and tucked in a manner not forming part of the invention so that the blank is ultimately converted into the inner, the outer or a median envelope or layer of a pack which is open at one end. A plunger or the like which can enter the mandrel 39 in the direction indicated by arrow 39*a* serves to expel the array of cigarettes and to simultaneously strip the pack off the mandrel so that the pack can be introduced into a suitable pocket of a further carrier (not shown) where its open end is closed and thereupon sealed by a revenue label (if the envelope obtained in response to conversion of blank B is the outer envelope of the pack).

The apparatus further comprises a feeding unit 1 for one of two webs 14, 16 which consist of sheet-like material (e.g., paper, metallic foil, soft cardboard or cellophane) and each of which can be subdivided at regular intervals to yield a succession of blanks B: The feeding unit 1 has two shafts 2*a*, 3*a* of analogous supports for bobbins 2, 3 which respectively constitute sources of webs 14 and 16. The web 14 is trained over two rollers 9 and 5 and is looped intermediate these rollers in a fixed guide or magazine 17*a* so as to form an intermediate supply 17 immediately downstream of the advancing roller 9 which is continuously driven by a suitable motor, not shown, through the medium of a shaft 9*a*. The web 16 is trained over two rollers 11 and 10 and forms a loop 18 which is stored in a fixed guide or magazine 18*a* and constitutes an intermediate supply immediately downstream of the advancing roller 11 which latter is continuously driven by the aforementioned motor (or by a separate motor) through the medium of a shaft 11*a*. The directions in which the advancing rollers 9 and 11 are driven are indicated by arrows.

The web 14 is the running or expiring web because the driven roller 9 cooperates with an idler roller 13 which is mounted on a changeover lever 13*a* articulately connected to the frame F of the packing machine and being pivotable by the armature 12*a* of an electromagnet 12 or by a fluid-operated motor (e.g., a pneumatic double-acting cylinder and piston unit). The roller 13 presses the web 14 against the driven roller 9 so that the web 14 is continuously advanced in a downward direction, as viewed in FIG. 1, along a second path and toward a locus which is adjacent to the path of mandrels 39 on the carrier 38. The web 16 is the fresh web, and the bobbin 3 does not rotate because the driven roller 11 simply rotates with respect to the adjacent portion of the web 16. When the electromagnet 12 is energized or deenergized to move the idler roller 13 from the illustrated position to a second position in which the roller 13 bears against the web 16 opposite the driven roller 11, the web 14 comes to a standstill and the web 16 begins to advance along a second path (i.e., downwardly, as viewed in FIG. 1).

The apparatus further comprises two web holding devices 4 and 6 which respectively comprise two-armed levers 19 and 21 pivotable about the axis of a fixedly mounted pin or shaft 27. The lower arm of the lever 19 carries an elastic clamping device 22 which yieldably engages the leader 14*a* of the web 14. A similar elastic clamping device 23 at the lower end of the lower arm of lever 21 yieldably engages the leader 16*a* of the web 16. The upper arms of the levers 19, 21 respectively carry roller followers 24, 26 which can respectively track disk-shaped displacing cams 33, 34 rotatably mounted on a fixed camshaft 35. The upper arms of the levers 19, 21 further carry pins 31, 32 which are couplied to each other by a helical spring 30. A single segment-shaped transfer member 28 is mounted on the shaft 27 and can swing from the illustrated position (in which it bears against the pin 32 and thereby indirectly urges the follower 24 of the lever 19 against the periphery of the cam 33) to a second position in which it bears against the pin 31 and thereby indirectly urges the follower 26 of the lever 21 against the periphery of the cam 34. The displacing cams 33, 34 are respectively formed with lobes 33*a* and 34*a*. The direction in which the cams 33, 34 are driven by or relative to the camshaft 35 is indicated by an arrow. The means for swinging the transfer member 28 between its two positions comprises an electromagnet 29 which is articulately connected to the frame F and has a reciprocable armature 29*a* articulately coupled to the transfer member 28 at a level above the shaft 27, as viewed in FIG. 1.

The elastic clamping devices 22, 23 for the leaders 14*a*, 16*a* of the webs 14, 16 can be replaced by clamping devices in the form of suction heads or the like. A suitable suction head will be described with reference to FIGS. 2–3.

The apparatus further comprises a severing device 7 having a reciprocable knife 36 and a sturdy stationary counterknife 37. The severing device 7 is mounted in or on the frame F inntermediate the clamping devices 22, 23 at the lower ends of lower arms of the levers 19, 21 and the path of movement of mandrels 39 on the indexible carrier 38. The directions in which the knife 36 is reciprocable by an electromagnet or another suitable motor are indicated by a double-headed arrow.

The apparatus still further comprises an intermediate conveyor 8 having an elongated arm 8*a* which is fulcrumed at 8*b* and is intermittently pivoted back and forth (as indicated by a double-headed arrow) by means of a drive (including a gear 8*g*) whose operation is synchronized with that of the means for indexing the carrier 38. The free end of the arm 8*a* carries a gripping device or tongs 8*d* (hereinafter called gripper) which opens automatically when it approaches the leader 14*a* or 16*a* at the first locus and thereupon closes so as to pull the web 14 or 16 downwardly and across the path of movement of successive mandrels 39 before the movable knife 36 performs a working stroke to sever the web 14 or 16 below the respective clamping device 22 or 23 and to thus form a discrete blank B which is ready to be entrained by the oncoming mandrel 39. The gripper 8*d* opens not later than when the freshly formed blank B is engaged by the oncoming mandrel 39, and the latter is preferably formed with means for attracting or otherwise holding the blank B so that the blank shares the movement of the respective mandrel in the direction indicated by arrow 38*a*.

The lever 19 or 21 constitutes a means for properly positioning the respective leader 14*a* or 16*a* at the first or second locus so that the leader of the advancing web can be engaged by the gripper 8*d* when the arm 8*a* of the intermediate conveyor 8 reaches its upper end position. While the lever 19 positions the leader 14*a* of the advancing or expiring web 14, the lever 21 maintains the leader 16*a* of the fresh web 16 in a (retracted) position of readiness (second locus), and vice versa, depending upon which of the two webs is being severed by the knives 36, 37. The lobe 33*a* pivots the lever 19 once during each revolution of the displacing cam 33. Thus, the clamping device 22 at the lower end of the lower arm of lever 19 assumes the position shown by phantom lines (first locus) when the leader 14*a* is to be engaged by the gripper 8*d* of the conveyor 8, and the clamping device 22 assumes the solid-line position of FIG. 1 just before the knife 36 performs a working stroke to separate a blank B from the web 14. In the last described position of the clamping device 22, a portion of the web 14 behind the leader 14*a* is immediately or closely adjacent to the cutting edge of the counterknife 37. The manner in which the displacing cam 34 pivots the lever 21 when the web 16 is the running web is analogous.

The operation of the apparatus of FIG. 1 is as follows:

As stated before, the web 14 is the expiring web because the idler roller 13 is adjacent to the continuously driven roller 9. The fresh web 16 has been threaded through the apparatus so that it forms the loop 18 and that its leader 16*a* extends beyond the clamping device 23 on the arm 21 of the web holding device 6. Since the roller follower 26 is remote from the associated displacing cam 34, the clamping device 23 maintains the leader 16*a* in a position (second locus) in which the leader 16*a* cannot be reached and engaged by the gripper 8*d* of the intermediate conveyor 8.

The lobe 33*a* of the rotating displacing cam 33 pivots the lever 19 of the holding device 4 to the phantom-line position of FIG. 1 not later than when the aforementioned drive pivots the arm 8*a* of the conveyor 8 clockwise so that the open gripper 8*d* has moved across the path of mandrels 39 and between the spaced-apart knives 36, 37 of the severing device 7 and can reach the leader 14*a* which is held at the first locus. The gripper 8*d* then closes around the leader 14*a* and the arm 8*a* is pivoted counterclockwise (back to the end position shown in FIG. 1) before the knife 36 performs a working stroke and before the oncoming mandrel 39 reaches the position shown in the drawing. The knives 36, 37 cooperate to form a blank B while the gripper 8*d* still engages the leader 14*a* of the web 4, but the gripper opens not later than when the blank B is engaged and entrained by the oncoming mandrel 39. Such blank B is then advanced with the mandrel in the direction indicated by arrow 38*a* to be converted into an envelope in a manner as outlined hereinabove.

The roller 9 cooperates with the roller 13 to continuously advance the web 14 from the bobbin 2 toward the roller 5. A loop 17 is formed while the leader 14*a* is held by the clamping device 22, and the size of this loop is reduced while the gripper 8*d* pulls the leader 14*a* downwardly across the path for the mandrels 39. Thus, the size of the loop 17 fluctuates in rhythm with movement of the gripper 8*d* between its two end positions. The lobe 33*a* moves beyond the upper arm of the lever 19 after the gripper 8*d* engages the leader 14*a* so that the spring 30 moves the lever 19 to the solid-line position of FIG. 1 in which the web 14 (between the gripper 8*d* which moves downwardly and the clamping device 22) is closely adjacent to the cutting edge of the stationary counterknife 37. This insures the making of clean cuts across the web, and such mode of operation further insures that the length of each blank B equals or practically equals an optimum standard length. If desired, the knives 36, 37 can sever the web 14 at the instant when or even after the web 14 is engaged by the front edge face of the respective mandrel 39.

The just described procedure is repeated again and again, whereby the movements of the arm 8*a*, knife 36, displacing cam 33 and roller 9 are synchronized with movements of the carrier 38 in the aforedescribed manner so that the apparatus makes and manipulates a succession of blanks B which are obtained in response too subdivision of the running web 14. When the supply of web 14 on the support 2*a* is nearly exhausted, a detector (e.g., a mechanical detector having an arm 2A which bears against the outermost convolution of the bobbin 2, or a photoelectric detector) furnishes a signal which causes the electromagnet or motor 12 to move the roller 13 on the change-over lever 13*a* toward the continuously driven roller 11 and the electromagnet 29 to pivot the transfer member 28 clockwise. The roller 13 then cooperates with the driven roller 11 to draw the web 16 off the bobbin 3, and the spring 30 urges the roller follower 26 of the lever 21 to bear against the periphery of the displacing cam 34. The transfer member 28 then maintains the lever 19 in an idle position in which the clamping device 22 is out of the way (second locus of the leader 14*a*) so that the clamping device 23 can move between two positions corresponding to the solid-line and phantom-line positions of the device 22, as viewed in FIG. 1. The gripper 8*d* engages successive leaders 16*a* of the web 16 and continues to cooperate with the severing device 7 to form a succession of blanks B which are engaged and entrained by oncoming mandrels 39. The attendant removes the remnant of the bobbin 2 from the shaft 2*a* and replaces this bobbin with a fresh bobbin the front portion of which is threaded through the apparatus so that its leader extends slightly beyond the clamping device 22. The pivotable arm of the mechanical detector for the diameter of the bobbin 3 is shown at 3A. The supply of web on a fresh bobbin is sufficient to afford ample time for the placing of a fresh bobbin onto the shaft 2*a* or 3*a* while the supply of web coming from an expiring bobbin is being exhausted.

The apparatus of FIG. 1 is relatively simple and compact because a single transfer member 28 suffices to effect the movement of the leader 14*a* from the first locus where the leader 14*a* can be reached by the gripper 8*b* to a second locus where the leader 14*a* is out of the way following nearly complete exhaustion of the supply of web on the bobbin 2, as well as to effect similar movements of the leader 16*a* of the fresh web. The holding device 6 constitutes a means for properly positioning the leader 16*a* at the second locus when the holding device 4 properly positions the leader 14*a* at the first locus, and vice versa. The parts 28, 29, 33, 34 together constitute a means for transferring the leaders 14*a*, 16*a* from the first locus (see the position of leader 14*a*) to the second locus (see the position of the leader 16*a*) and vice versa in response to a changeover from advancement of the running web to advancement of the fresh web or vice versa.

Figure 2:
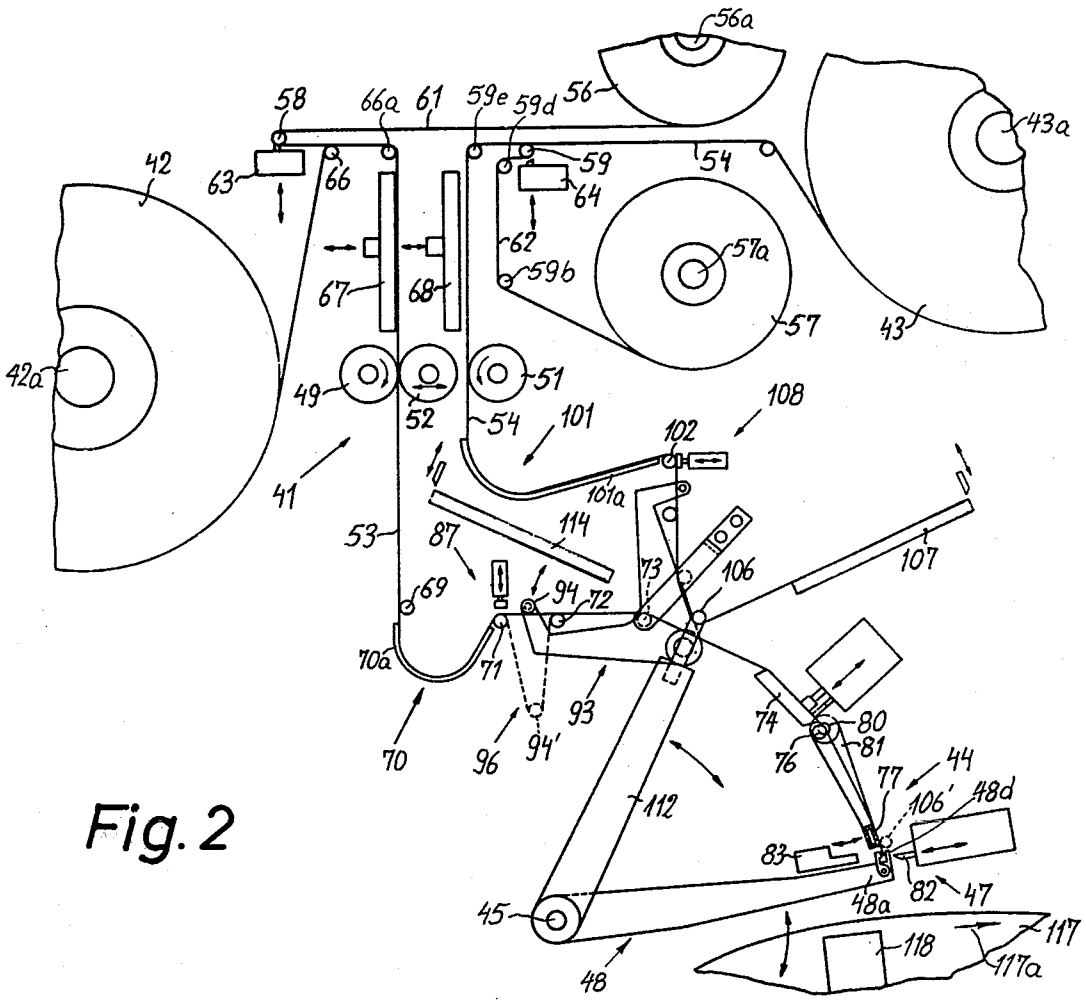
FIG. 2 is a similar fragmentary schematic elevational view of a second apparatus.
Figure 3:
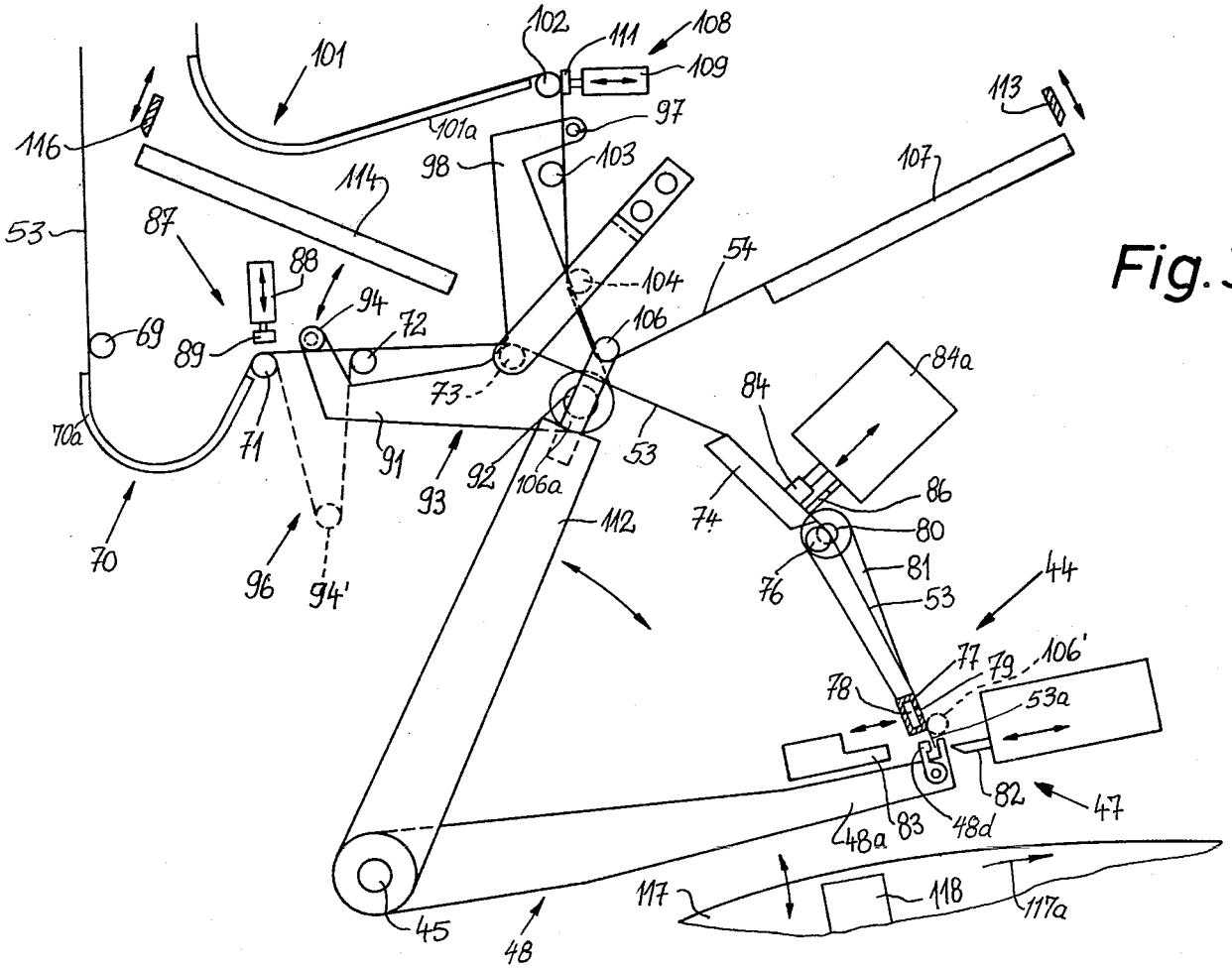
FIG. 3 is an enlarged view of a detail in the apparatus of FIG. 2.

The apparatus of FIGS. 2 and 3 comprises a feeding unit 41 including shafts 42*a*, 43*a* for two bobbins 42, 43 which respectively constitute sources of elongated webs 53 and 54, a single web holding device 44, a single severing device 47, and a single intermediate conveyor 48 having an arm 48*a* fulcrumed at 45 and a gripper or tongs 48*d* at the free end of the arm 48*a*. An indexible carrier or turret 117 supports a series of entraining elements here shown as cigarette packs 118 (only one shown) each of which is to be divided with a transparent or translucent outer envelope or layer having a tear strip. The webs 53, 54 consist of cellophane or a similar light-transmitting synthetic plastic material which can be readily bonded to tear strips.

The feeding unit 41 further comprises two constantly driven advancing rollers 49, 51 (corresponding to the advancing rollers 9, 11 of FIG. 1) and an idler roller 52 which is a functional equivalent of the roller 13 and can be shifted in directions indicated by a double-headed arrow by means of an electromagnet or another suitable changeover device, not shown. When the roller 52 assumes the left-hand end position shown in FIG. 2, it biases the adjacent portion of the web 53 against the periphery of the continuously driven advancing roller 49 whereby the latter draws the web 53 off the bobbin 42. If the idler roller 52 is shifted to its right-hand end position, it cooperates with the continuously driven advancing roller 51 to draw the web 54 off the bobbin 43.

The feeding unit 41 also comprises two additional shafts 56*a*, 57*a* which support removable bobbins or reels 56, 57 containing convoluted webs or bands 61, 62 which can be converted into discrete tear strips adhering to the respective transparent or translucent blanks. The band 61 is trained over a guide roll 58 and comes into contact with the web 53 during travel along a guide roll 66 for the web 53. From there on, the web 53 and band 61 advance as a unit. During travel around the guide roll 58, the outer side of the band 61 is coated with adhesive which is supplied by a suitable paster 63. The latter is movable up and down (as indicated by a double-headed arrow) so that its applicator can be moved out of contact with the band 61 while the reel 56 does not rotate to pay out the band 61. The guide roll 66*a* which causes the web 53 and band 61 to move downwardly, as viewed in FIG. 2. The adhesive which is supplied by paster 63 insures that the band 61 adheres to a selected portion of the web 53; however, a final and sufficiently strong bond between the web 53 and band 61 is preferably established by resorting to a welding electrode 67 which is adjacent to the path of movement of the web 53 downstream of the guide roll 66*a* and is movable to and from the illustrated operative position (see the double-headed arrow). The electrode 67 assumes the operative position of FIG. 2 when the idler roller 52 cooperates with the driven advancing roller 49 to draw the web 53 off the reel 42. It is clear that the rollers 49, 51 need not be driven if the roller 52 is driven (this also applies for the rollers 11, 12 and the roller 13 of FIG. 1).

The web 54 is trained over a guide roll 59*a* and comes into contact with the band 62 in the region of a guide roll 59 where the band 62 can be coated with adhesive supplied by a retractable paster 64. The band 62 is trained over additional guide rolls 59*b*, 59*d* which are mounted in the frame of the packing machine intermediate the reel 57 and guide roll 59. Once the web 54 and band 62 advance beyond the roll 59, they travel in unison over a guide roll 59*e* and thereupon downwardly toward the periphery of the driven roller 51. The paster 64 for the band 62 is shown in retracted (lower end) position because the idler roller 52 does not bear against the web 54. The welding electrode 68 for the band 62 is also retracted; this electrode is shown adjacent to the path for the web 54 and band 62 intermediate the guide roll 59*e* and driven roller 51. The electrodes 67, 68 can be coupled to a common drive (e.g., to the armature of an electromagnet or to the piston rod of a fluid-operated motor, not shown) which automatically retracts the electrode 68 when the electrode 67 is moved to operative position and vice versa. The manner in which the electrodes are heated, at least while in their respective operative positions, forms no part of the invention. These electrodes can be heated by a circulating hot fluid and/or electrically.

The web 53 (with the band 61 welded thereto) advances beyond the rollers 49, 52 and forms a loop 70 in an arcuate guide 70*a* which extends between guide rolls 69 and 71. The latter is adjacent to an arresting or blocking device 87 having an electromagnet 88 with a reciprocable armature 89 which can be caused to descend and to urge its head against the web 53 opposite the guide roll 71 so that the web 53 is positively arrested and held in a predetermined position. The head of the armature 89 is in the retracted position because the web 53 is the running web, and such web advances beyond the guide roll 71, along one side of a plate-like table 74, over a further guide roll 76 and on to a pneumatic clamping device 77. This clamping device is a suction head having a suction chamber 78 (FIG. 3) and one or more ports 79 which draw air into the chamber 78 and thereby attract the leader 53*a* of the web 53 to the clamping device 77. The device 77 forms part of the holding means 44 and is shown as being positioned in such a way that the leader 53*a* can be engaged by the gripper 48*d* of the arm 48*a* when the latter assumes the upper end position shown in FIG. 2 or 3. The gripper 48*d* closes around the leader 53*a* and the arm 48*a* pivots clockwise to pull a length of the web 53 (and the corresponding portion of the band 61) between the knives 82, 83 of the severing device 47 and thereupon across the path of packs 118 which travel along an endless circular path indicated by the arrow 117*a*.

The holding device 44 comprises an arm 81 which can swing the clamping device 77 about the axis of a pivot member 80. Once the leader 53*a* is engaged by the gripper 48*d* and before the movable knife 82 performs a working stroke, the arm 81 pivots clockwise, as viewed in FIG. 2 or 3, so that the web 53 is immediately adjacent to the cutting edge of the sturdy stationary counterknife 83 before a blank (with a tear strip thereon) is separated from the parent material of the web 53.

The aforementioned plate-like table 74 constitutes a stationary counterknife and cooperates with a movable knife 84 whose cutting edge provides longitudinally spaced portions of the web 53 with substantially U-shaped incisions in order to enable the purchaser of a cigarette pack to reach one end of the tear strip and to remove a portion of the transparent envelope which surrounds the revenue label. The motor 84*a* for the knife 84 receives impulses at regular intervals in synchronism with pivotal movements of the arm 81 so that each blank is formed with a U-shaped incision and that such incision is made at the exact location where a smoker normally expects to find the end of the tear strip.

The knife 84 is followed by a paster 86 which coats selected portions of the web 53 with an adhesive so that such portions adhere to selected other portions when the respective blank is converted into a transparent or translucent outermost envelope or layer of a pack 118.

The apparatus of FIGS. 2 and 3 further comprises a fixed shaft 92 for a bell crank lever 93 the left-hand arm 91 of which carries a roller-shaped deflector or looping element 94. When the lever 93 is pivoted counterclockwise, as viewed in FIG. 2 or 3, the deflector 94 moves to the position 94′ and causes the web 53 to form a loop 96 which extends between the guide roll 71 and a further guide roll 72. The deflector 94 is preferably removable from a suitable socket in the left-hand arm 91 of the lever 93 so that it can be inserted into a second socket 97 provided in the other arm 98 of the lever 93.

That portion of the fresh web 54 which extends beyond the driven roller 51 forms a loop 101 in an arcuate guide 101*a* and overlies a guide roll 102 which cooperates with an arresting device 108 analogous to the arresting device 87. The guides 70*a* and 101*a* constitute magazines for storage of intermediate supplies of webs 53, 54 extends between the guide roll 102 and the head of the armature 111 of the electromagnet 109 of blocking device 108, around a guide roll 106, and overlies the upper side of an elongated suction chamber 107. The latter constitutes a stationary counterknife for a movable trimming knife 113 which can be actuated by hand to clip the foremost end of the web 54 before the web is displaced so as to adhere to the clamping device 77.

The means for transferring the leader of the web 54 from the suction chamber or counterknife 107 into the range of the clamping device 77 comprises a lever 112 which can turn about the axis of the pivot member 45 for the arm 48*a* and whose free end carries the guide roll 106. This roll is movable between the solid-line position and the broken-line position 106′ of FIG. 2 or 3. The holder 106*a* for the guide roll 106 is inserted into and is removable from a socket or hole in the free end of the transfer lever 112. The guide roll 106 is a means for stripping the leader of the web 54 off the suction chamber 107.

When the running web 53 is replaced with a fresh web, i.e., when the bobbin 42 is replaced with a fresh bobbin, the leader of the web coming from such fresh bobbin is placed onto the upper side of a second suction chamber 114 (similar to the suction chamber 107)

which can cooperate with a manually actuatable trimming knife 116 to clip the foremost end of the freshly introduced web.

The operation of the apparatus shown in FIGS. 2 and 3 is as follows:

The web 53 is the running web because the idler roller 52 is held in the illustrated position and causes the continuously driven advancing roller 49 to transport the web 53 and the band 61 downwardly toward the guide roll 69. The band 61 is coated with adhesive by the paster 63 and is bonded to the web 53 by the electrode 67. The gripper 48*d* engages the leader 53*a* of the web 53 at regular intervals and the arm 48*a* thereupon pivots clockwise, as viewed in FIG. 2, to pull a length of the web 53 and band 61 across the path of the oncoming cigarette pack 118. Such length of the web 53 passes between the spaced-apart knives 82, 83 of the severing device 47. The arm 81 of the holding device 44 thereupon pivots the clamping device 77 in a clockwise direction so that the just discussed length of the web 53 (between the clamping device 77 and the gripper 48*d*) is closely adjacent to the cutting edge of the counterknife 83 before the reciprocable knife 82 performs a working stroke (in a direction to the left, as viewed in FIG. 2 or 3). The arm 81 is thereupon pivoted back to the illustrated position so that the freshly formed leader 53*a* is again in the range (first locus) of the gripper 48*d*. The loop 70 is spent or nearly spent when the gripper 48*d* pulls a length of the web 53 downwardly and beyond the clamping device 77, but the loop 70 is restored immediately thereafter because the advancing roller 49 is driven at a constant speed and without interruptions.

The web 54 and the band 62 are threaded into the apparatus while the web 53 is running. The paster 64 can be temporarily lifted to its operative position during threading of the web 54 and band 62 to insure that the band 62 adheres to the web 54. That portion of the web 54 which extends beyond the guide roll 102 is trained over the guide roll 106 and overlies the active surface of the suction chamber 107. The trimming knife 113 is actuated by hand to clip the foremost part of the web 54; this insures that the web portion between the guide roll 102 and the right-hand end of the suction chamber 107 has a predetermined length. The arresting device 108 causes the head of the armature 111 to bear against the web 54 opposite the guide roll 102. On its way from the guide roll 102 to the guide roll or stripping means 106, the fresh web 54 preferably passes along two additional guide rolls 103, 104 shown in FIG. 3.

When the supply of web 53 and/or band 61 is nearly exhausted (the diameters of the bobbin 42 and reel 56 are preferably monitored in a manner as described in connection with FIG. 1, see the movable arms 2A and 3A), the respective monitoring device or detector transmits a signal which causes the changeover device th shift the idler roller 52 to its right-hand end position so that the web 53 ceases to advance forwardly but the rollers 51, 52 cooperate to advance the web 54 and band 62 toward the arcuate guide or magazine 101*a*. The aforementioned signal from the means for monitoring the diameter of the bobbin 42 and/or reel 56 is further transmitted to the mechansim for shifting the paster 63, to the mechanism for shifting the paster 64, and to the means for moving the welding electrodes 67, 68. The paster 63 is moved downwardly, the paster 64 is moved upwardly, the electrode 67 is moved to its retracted position, and the electrode 68 is moved to its operative position. At the same time, the electromagnet 88 of the arresting device 87 is caused to move its armature toward the guide roll 71 so that the web 53 is firmly engaged and held against further forward movement. As soon as the armature 89 engages the web 53, the bell crank lever 93 is pivoted counterclockwise so that the deflector 94 moves to the position 94′ and causes the web 53 to form a loop 96. Such looping of the web 53 at 96 results in retraction of the leader 53*a*, i.e., the leader is caused to slide upwardly off the ported surface of the clamping device 77 and also off the table 74.

The transfer lever 112 is then caused to pivot clockwise, as viewed in FIG. 2 or 3, whereby the guide roll 106 strips the foremost part of the fresh web 54 off the active surface of the suction chamber 107. When the guide roll 106 reaches the position 106′, the web 54 adheres to the ported surface of the clamping device 77 and its leader extends downwardly beyond such ported surface so that it can be engaged by the gripper 48*d* of the intermediate conveyor 108. The electromagnet 109 of the arresting device 108 thereupon retracts its armature 111 so that the web 54 and the band 62 can travel downwardly beyond the guide roll 102 and the gripper 48*b* begins to pull predetermined lengths of the web 54 and band 62 between the knives 82, 83 and across the path of successive cigarette packs 118, always before the severing device 47 is actuated to form discrete blanks.

The ball crank lever 93 and the transfer lever 112 thereupon return to the illustrated positions during the next interval of idleness of the web 54 between the guide member 101*a* and clamping device 77. This causes the guide roll 106 to return into contact with the web 54. The electromagnet 88 of the arresting device 87 is thereupon caused to retract its armature 89 so that the remnants of the web 53 and band 61 can be removed from the apparatus, together with the remnant of the bobbin 42 and reel 56. The operator then places a fresh bobbin onto the shaft 42*a* and a fresh reel onto the shaft 56*a*. The deflector 94 is detached from the left-hand arm 91 of the bell crank lever 93 and is inserted into the socket 97 of the other arm 98. The holder 106*a* for the guide roll 106 is removed from the socket or hole of the transfer lever 112 and is reinserted into the socket but in such a way that the guide roll 106 does not overlie the running web 54. The web coming from the fresh bobbin on the shaft 42*a* and the band coming from the fresh reel on the shaft 56*a* are then threaded into the apparatus in a manner as shown for the web 53 and band 61 all the way to the guide roll 72. From there on, the fresh web (with the fresh band adhering thereto because the paster 63 can be temporarily lifted to its operative position during threading of the fresh web) is caused to pass around the guide roll 106 on the transfer lever 112 (counterclockwise, as viewed in FIG. 2 or 3) and to overlie the active upper side of the suction chamber 114. The electromagnet 88 is caused to move the armature 89 to the extended position when the foremost portion of the fresh web extends beyond the left-hand end of the suction chamber 114 so that it can be clipped by the manually actuable trimming knife 116. This insures that the portion of fresh web extending from the head of the armature 89 to the left-hand end of the suction chamber 114 has a predetermined length, i.e., that a satisfactory leader of the fresh web will extend beyond the clamping device 77 when the transfer lever 112 thereupon moves the guide roll 106 to the position 106° upon complete or nearly complete exhaustion of the supply of web 54 and/or band 62. The operator preferably pulls the foremost part of the fresh web after the arresting device 87 is activated and prior to actuation of the timming knife 116 to thus insure that the fresh web is free of small loops or other unevennesses at the time of clipping by the knife 116.

The apparatus is then ready for a changeover from transport of the expiring web 54 to transport of the fresh web. This takes place when the monitoring means of the apparatus detects that the supply of web 54 and/or the supply of band 62 is nearly exhausted. As the bell crank lever 93 pivots counterclockwise (after the arresting device 108 causes the armature 111 of its magnet 109 to bear against the web 54 opposite the guide roll 102), the deflector 94 (now in the socket 97 of the arm 98) causes the web 54 to form a loop similar to the loop 96 whereby the leader of the web 54 is retracted from the clamping device 77 and upwardly beyond the table 74. The transfer lever 112 thereupon pivots clockwise to move the guide roll 106 to the position 106′ and to thus insure that the leader of the fresh web is stripped off the suction chamber 114 and extends beyond the ported surface of the clamping device 77 to be within reach of the gripper 48*d* on the arm 48*a* of the intermediate conveyor 108. The retracted web 54 forms a loop between the guide rolls 102 and 103.

It will be noted that the arresting devices 87, 108 are actuated when it becomes necessary to retract the leader of a nearly expired web as well as during transfer of the leader of a fresh web from the suction chamber 107 or 114 (second locus) into the range of suction ports 78 in the clamping device 77.

The transferring means of the apparatus shown in FIGS. 2 and 3 includes the parts 87, 94 and 106, 108. The parts 87, 94 constitute a device for moving the leader 53*a* of the web 53 from the first locus (at which the leader 53*a* adheres to the clamping device 77 and is in the range of the gripper 48*d*), and the parts 106, 108 constitute a device for moving the leader of the web 54 from its second locus (at the upper side of the suction chamber 107 and adjacent to the trimming knife 113) to the first locus. The arresting device 87 blocks the movement of the web 53 during withdrawal of the leader 53*a* from the first locus (by the lever 94), and the arresting device 108 blocks the movement of the web 54 prior and during actuation of the lever 112 to move the leader of the web 54 to the first locus. The arresting devices 87, 108 are further operative when the respective webs are held in positions of readiness, i.e., prior to changeover from transport of the running web to transport of the fresh web.

An important advantage of the improved apparatus is that the carrier 38 or 117 can receive a practically uninterrupted series of blanks B, and that the likelihood of malfunction is very remote because an attendant has ample time to properly install a fresh web while the other web is being converted into a series of discrete blanks. The likelihood of mulfunction is further reduced due to the fact that the gripper of the intermediate conveyor 8 or 48 pulls the leader of the running web across the path of successive entraining elements 39 or 118. Such mode of operation insures that the carrier 38 or 117 receives a succession of blanks B at regular intervals, not only while the blanks are being formed in response to severing of the running web but also during changeover from advancement of a nearly expired web to advancement of a fresh web. Moreover, the discrete (second) paths for the running and fresh webs can be spaced apart so that an attendant can readily thread a fresh web while the other web is running. The auxiliary equipment (such as pasters, electrodes, trimmers and incision forming means) is simple, compact and readily accessible, irrespective of whether the apparatus advances the web along the one or the other second path. Still further, at least some parts of the apparatus (such as the movable knife 84, paster 86, clamping device 77, severing device 7 or 47, intermediate conveyor 8 or 48, and others) can perform their functions during advancement of the one or the other web.

The advantages of the intermediate conveyor 8 or 48 (whose gripper 8*d* or 48*d* pulls the running web across the path of oncoming entraining elements 39 or 118) will be appreciated by bearing in mind that certain types of webs which are used in packing machines or the like exhibit a pronounced tendency to fold, curl and/or crinkle. Such types of webs cannot be subdivided into blanks of predetermined length and the blanks cannot be positioned in the path of oncoming entraining elements with a sufficient degree of accuracy and reproducibility if the web is pushed, rather than pulled, across the path of entraining elements 39 or 118. The clamping device 22, 23 or 77 resists the forward movement of the respective web under the action of the gripper 8*d* or 48*d* so that the web portion between the clamping device and the gripper is taut during severing by the device 7 or 47. This renders it possible to form a continuous succession of blanks with a highly satisfactory degree of reproducibility even if the material of the running web exhibits a pronounced tendency to fold, crinkle or curl. The likelihood that the relatively short leader of a web which extends beyond the clamping device 22, 23 or 77 would tend to curl to such an extent that it could not be properly engaged by the gripper 8*d* or 48*d* is very remote. As stated above, the making of clean cuts across longitudinally spaced portions of the running web is insured owing to the fact that the clamping device 22, 23 or 77 moves the running web close to the counterknife 37 or 83 before the movable knife 36 or 82 performs a working stroke to separate a blank from the running web.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

1. Apparatus for manipulating a succession of blanks which are obtained by severing webs of sheet-like material, particularly for making and transporting blanks in a packing machine for cigarettes or the like, comprising a mobile carrier having blank entraining means arranged to move along a first path; feeding means having first and second sources of discrete webs and means for advancing one of said webs at a time from the respective source along second paths; means for holding the leader of said one web at a first locus adjacent to said first path and for holding the leader of the other of said webs at a second locus; a conveyor movable between first and second positions and having means for gripping the leader of said one web at said first locus in said first position of said conveyor and for moving such leader across said first path during movement of said conveyor to said second position; means for thereupon severing said one web adjacent to said first locus to thereby form a blank which is moved by said entraining means along said first path; and means for transferring the leader of said one web from said first locus and the leader of said other web from said second to said first locus in response to a changeover from advancement of said one web to advancement of said other web.

2. Apparatus as defined in claim 1, wherein said advancing means comprises a device for continuously drawing said one web from the respective source and further comprising magazines for storage of intermediate supplies of respective webs in predetermined portions of said second paths downstream of said advancing means.

3. Apparatus as defined in claim 1, further comprising means for intermittently moving said conveyor between said first and second positions.

4. Apparatus as defined in claim 3, wherein said conveyor comprises means for reciprocating said gripping means between said first and second positions.

5. Apparatus as defined in claim 4, wherein said gripping means comprises a tongs.

6. Apparatus as defined in claim 1, wherein said severing means comprises a stationary counterknife and a mobile knife, said transferring means comprising means for displacing said holding means during movement of said conveyor to said second position so that a portion of said one web is closely adjacent to said counterknife while said one web is being severed by said knives.

7. Apparatus as defined in claim 1, wherein said holding means comprises discrete first and second holding devices for the leaders of said one and said other web, and said transferring means comprises a single member for moving said first and second holders in response to said changeover so that the leader of said one web is moved to said second locus simultaneously with movement of the leader of said other web to said first locus, and vice versa.

8. Apparatus as defined in claim 7, wherein said transferring means further comprises means for moving said single member alternately into engagement with said first and second holding devices.

9. Apparatus as defined in claim 1, wherein said holding means comprises a suction-operated clamping device for the leader of said one web.

10. Apparatus as defined in claim 9, wherein said clamping device is a suction head.

11. Apparatus as defined in claim 1, wherein said transferring means comprises discrete first and second devices for respectively moving the leader of said one web from said first locus and the leader of said other web to said first locus.

12. Apparatus as defined in claim 11, wherein said holding means comprises a clamping device for the leader of said one or said other web and said first device of said transferring means includes means for withdrawing the leader of said one web from said clamping device.

13. Apparatus as defined in claim 12, wherein said first device of said transferring means further comprises arresting means arranged to block said one web in the respective second path upstream of said clamping device prior to actuation of said withdrawing means.

14. Apparatus as defined in claim 11, wherein said second device of said transferring means comprises arresting means arranged to block said other web in the respective second path upstream of said clamping device and means for thereupon moving the leader of said other web from said second locus to said clamping device.

15. Apparatus as defined in claim 11, further comprising means for trimming the leader at said second locus.

16. Apparatus as defined in claim 15, wherein said trimming means comprises discrete severing devices for the leaders of said one and said other web.

17. Apparatus as defined in claim 11, wherein each of said first and second devices comprises means for arresting the respective web when the leader of such web occupies said second locus, during withdrawal of said one web from said first locus and during movement of said other web to said first locus.

* * * * *

UNITED STATES PATENT OFFICE

CERTIFICATE OF CORRECTION

PATENT NO. : 3,948,020

DATED : April 6, 1976

INVENTOR(S) : Reinhard Deutsch, Manfred Rudolph, Karl-Heinz Pawelko and Willy Rudszinat It is certified that error appears in the above-identified patent and that said Letters Patent are hereby corrected as shown below:

Col. 1, line 47, "s" should read --is--.
line 56, "markers" should read --makers--.

Col. 2, line 35, after the word "adheres" the following should be inserted --to one of the drums and another for the web which adheres--.

Col. 3, line 29, "advancing" should read --(advancing)--.
line 32, "closed" should read --close--.

Col. 4, line 50, "of" should read --or--.

Col. 5, line 33, "couplied" should read --coupled--.
line 59, "inntermediate" should read --intermediate--.

Col. 7, line 3, "4" should read --14--.
line 36, "too" should read --to--.

Col. 8, line 28, "divided" should read --provided--.
line 62, after the word "guide" the following should be inserted --roll 66 is followed by a further guide--.

Col. 11, line 58, "th" should read --to --.

Col. 12, line 68, "actu-" should read --actuat--.

Signed and Sealed this

Thirty-first Day of August 1976

[SEAL]

*Attest:*

RUTH C. MASON
*Attesting Officer*

C. MARSHALL DANN
*Commissioner of Patents and Trademarks*